US006425268B1

(12) United States Patent
Anderson

(10) Patent No.: US 6,425,268 B1
(45) Date of Patent: Jul. 30, 2002

(54) BODY PIERCING JEWELRY SUBSTITUTE AND METHOD OF APPLICATION

(76) Inventor: Dwayne Anderson, 820-10 Street S.W., Calgary, Alberta (CA), T2P 2X1

( * ) Notice: Subject to any disclaimer, the term of this patent is extended or adjusted under 35 U.S.C. 154(b) by 0 days.

(21) Appl. No.: 09/495,637

(22) Filed: Feb. 1, 2000

(51) Int. Cl.[7] ..... A44C 7/00

(52) U.S. Cl. ..... 63/12; 63/14.1; 63/14.9; 63/33

(58) Field of Search ..... 63/12, 14.1, 14.9, 63/33

(56) References Cited

U.S. PATENT DOCUMENTS 1,140,975 A * 5/1915 Frankel ..... 2/1
1,300,592 A * 4/1919 Essig ..... 2/1
4,220,016 A * 9/1980 Frenger ..... 63/14.9
4,590,775 A 5/1986 Rivaud ..... 63/14 G
4,625,526 A 12/1986 Milawski ..... 63/2
5,233,845 A * 8/1993 D'Andrade ..... 63/14.9
6,026,659 A * 2/2000 Kaping, Jr. ..... 63/12
6,167,725 B1 * 1/2001 Siekierski ..... 63/12
6,244,073 B1 * 6/2001 Kaping, Jr. ..... 63/12

* cited by examiner

*Primary Examiner*—Jack Lavinder
*Assistant Examiner*—Andrea Chop
(74) *Attorney, Agent, or Firm*—David S. Thompson

(57) ABSTRACT

A body piercing jewelry substitute 10 includes a body 20 having an internal cavity 30. A rim 22 frames the opening 23 to the internal cavity. The rim is positioned on a damp body surface, such as moistened skin or the user's tongue. By creating an area 500 of reduced pressure around the body 20, air is removed from the internal cavity 30, lowering the pressure within the body 20. Where the body piercing jewelry substitute is applied to the tongue, the area of reduced pressure may be created by sucking orally. Where the body piercing jewelry substitute is located on the cheek for example, the reduced pressure may be created by use of a suction cup. When pressure is restored to normal levels around the body, the rim adheres to the damp body surface due to the partial vacuum within the internal cavity. The body piercing jewelry substitute may then moved to a different location by sliding it on the damp body surface. The body piercing jewelry substitute may easily be removed by breaking the seal between the rim and the damp body surface.

5 Claims, 2 Drawing Sheets

BODY PIERCING JEWELRY SUBSTITUTE AND METHOD OF APPLICATION

CROSS-REFERENCES

There are no applications related to this application filed in this or any foreign country.

BACKGROUND

It is well-known that increasing numbers of people, including the young in particular, have been experimenting with new forms of jewelry, including jewelry which depends for its support on piercing portions of the body, including the tongue and locations on the face, including cheeks, lips and nostrils.

Referring to FIG. 1, Prior Art, the known body piercing jewelry 400 typically provides upper and lower balls 401, 402 and an interconnecting threaded stud 403. The upper and lower balls are typically carried on either side of the tongue 100, cheek, lip or nostril.

While such jewelry is fashionable in certain company, the long-term effects of pierced tongues, lips, cheeks and noses are generally undesirable. The damage to tissue may result in scar tissue formation and infection.

What is needed is a new form of ornamental jewelry, having a structure and method of application which does not do permanent damage to the user, which does not require the body to be pierced, but which delivers the full effect of conventional body piercing jewelry.

For the foregoing reasons, there is a need for an ornamental body piercing jewelry substitute and method of application.

SUMMARY

The present invention is directed to an apparatus that satisfies the above needs. A novel ornamental body piercing jewelry substitute and method of application which does not require any body piercing, but which does appear to have resulted in body piercing is disclosed.

The body piercing jewelry substitute and method of application of the present invention provides some or all of the following procedural steps.

(A) A location on the user's body is selected for the application of the body piercing jewelry substitute. The location selected is typically the user's tongue, or the outside of the cheek.

(B) The selected location is slightly dampened by water or saliva.

(C) The body piercing jewelry substitute, including a body 20 having an exterior sidewall 21 within which is defined an interior cavity 30 and including a lower rim 22 defining an opening 23 which allows air to move into and out of the cavity, is placed on the selected location.

(D) The air pressure is reduced in the area 500 adjacent to the body piercing jewelry substitute. Reduction of the air pressure adjacent to the body causes some air to leave the cavity defined within the body.

(a) Where the body 20 is carried by the user's tongue, the air pressure is reduced by the user by orally sucking, typically by withdrawing the tongue while keeping the lips closed.

(b) Where the body is carried by slightly dampened skin, the air pressure is reduced by application of a suction cup 300.

(E) The air pressure is restored to normal levels in the area adjacent to the body. Due to the lower air pressure within the cavity of the body, the surface of the tongue or skin is drawn slightly into the opening 23 defined by the rim 22 of the body, thereby maintaining a seal between the tongue or skin and the rim 22.

(F) The body piercing jewelry substitute may then be moved by sliding the lower rim 22 along the damp surface of the tongue or skin. For example, the body piercing jewelry substitute may be slid from the cheek to the lip or nose, if desired.

(G) The body piercing jewelry substitute may then be removed by gently breaking the seal between the rim 22 and the supporting tongue or skin.

It is therefore a primary advantage of the present invention to provide a novel body piercing jewelry substitute and method of application which does not require the skin of the user to be pierced.

Another advantage of the present invention is to provide a novel body piercing jewelry substitute and method of application which may more easily put on and taken off by the user than conventional body piercing jewelry.

A still further advantage of the present invention is to provide a novel body piercing jewelry substitute and method of application which does not result in body deformation, disease or susceptibility to infection.

Other objectives, advantages and novel features of the invention will become apparent to those skilled in the art upon examination of the specification and the accompanying drawings.

DRAWINGS

These and other features, aspects, and advantages of the present invention will become better understood with regard to the following description, appended claims, and accompanying drawings where:

FIG. 1, Prior Art, is a cross-sectional view of conventional body piercing jewelry applied to a user's tongue. Upper and lower balls are attached to a threaded stud.

DESCRIPTION

Figure 1:
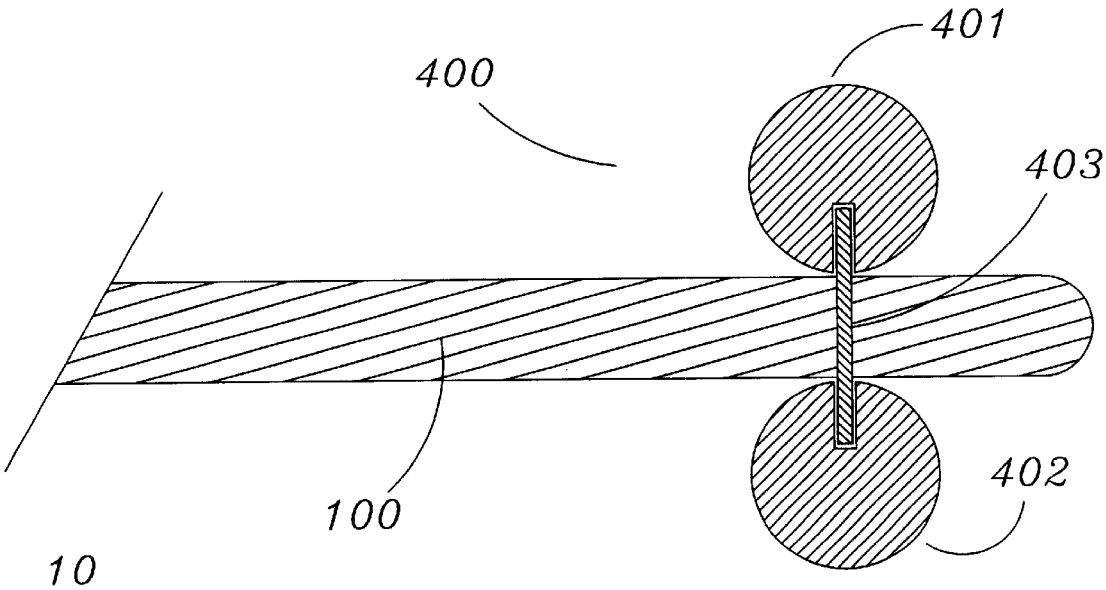
FIG. 1 Prior Art

Referring in generally to FIGS. 2 through 6, a body piercing jewelry substitute 10 constructed in accordance with the principles of the invention is seen. The body piercing jewelry substitute includes a body 20 having an internal cavity 30. A rim 22 frames the opening 23 to the internal cavity. The rim is positioned on a damp body surface, such as moistened skin or the users tongue. By creating an area 500 of reduced pressure around the body 20, air is removed from the internal cavity 30, lowering the pressure within the body 20. Where the body piercing jewelry substitute is applied to the tongue, the area of reduced pressure may be created by sucking orally. Where the body piercing jewelry substitute is located on the cheek for example, the reduced pressure may be created by use of a suction cup 300. When pressure is restored to normal levels around the body, the rim adheres to the damp body surface due to the partial vacuum within the internal cavity. The body piercing jewelry substitute may then moved to a different location by sliding it on the damp body surface. The body piercing jewelry substitute may easily be removed by breaking the seal between the rim and the damp body surface.

A location on the user's body is selected for the application of the body piercing jewelry substitute. The location selected is typically the wet upper surface 101 of the user's tongue 100, or the outside skin 200 of the cheek. Where the location selected is a specific site on the tongue, the experienced user is typically able to positioned the body piercing jewelry substitute with some accuracy. The inexperienced user may have to reposition the jewelry 10 after it adheres to the surface of the tongue, in the manner seen below.

Where the location selected is not on the tongue, it is frequently necessary to select a location, such as the cheek, over which it is possible to position a suction cup.

The selected location is slightly dampened by water or saliva. The tongue is generally sufficiently damp in its normal state. Where the jewelry 10 is to be located on the cheek 200 or other location, it is desirable to apply enough water to result in a damp body surface.

Figure 2:
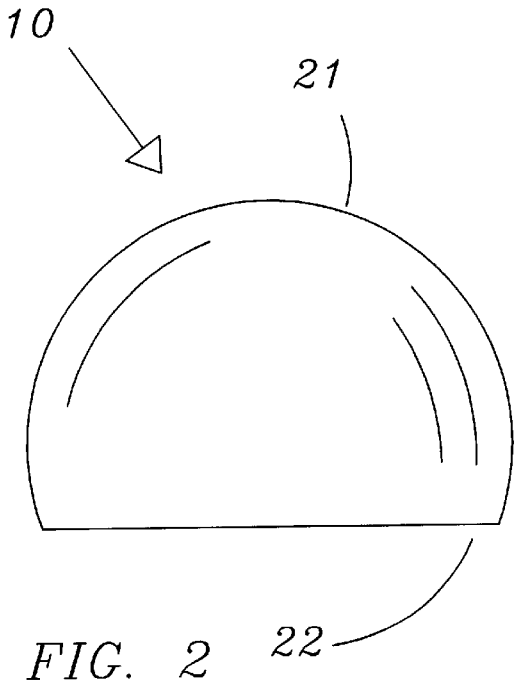
FIG. 2 is a side orthographic view of a preferred version of the body piercing jewelry substitute, showing the generally rounded exterior sidewall.
Figure 3:
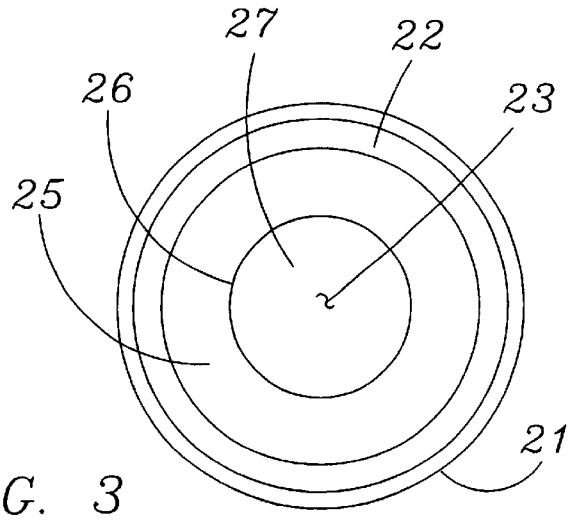
FIG. 3 is a bottom orthographic view of the version of the invention of FIG. 2, showing the lower rim which makes contact with the moist skin or tongue of the user.

As seen in FIGS. 2 and 3, the body piercing jewelry substitute 10 includes a body 20 having an exterior sidewall 21 within which is defined an interior cavity 30. A lower rim 22 frames an opening 23 which allows air to move into and out of the cavity.

Figure 4:
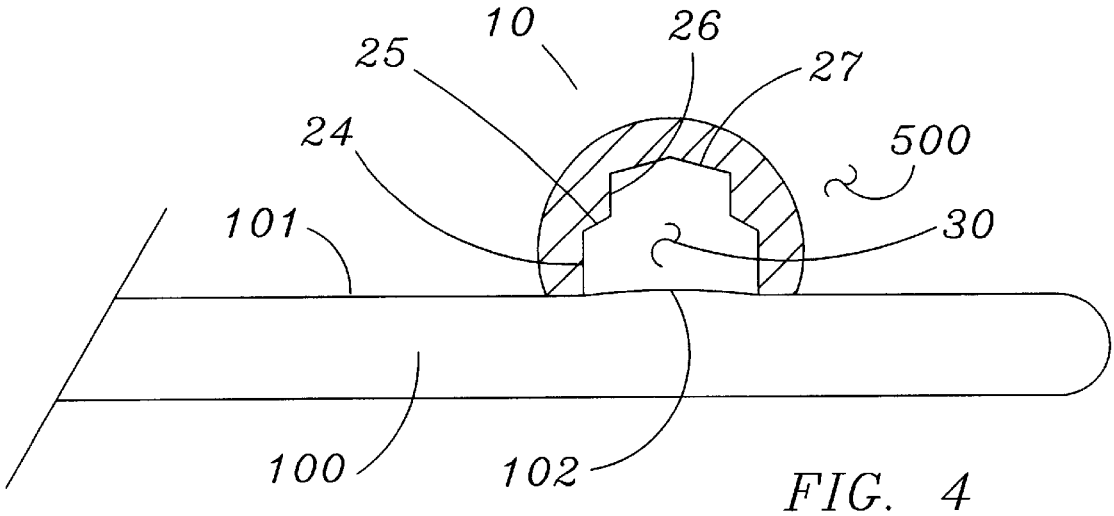
FIG. 4 is a side cross-sectional view of the version of the invention of FIG. 2 carried by the user's tongue.
Figure 5:
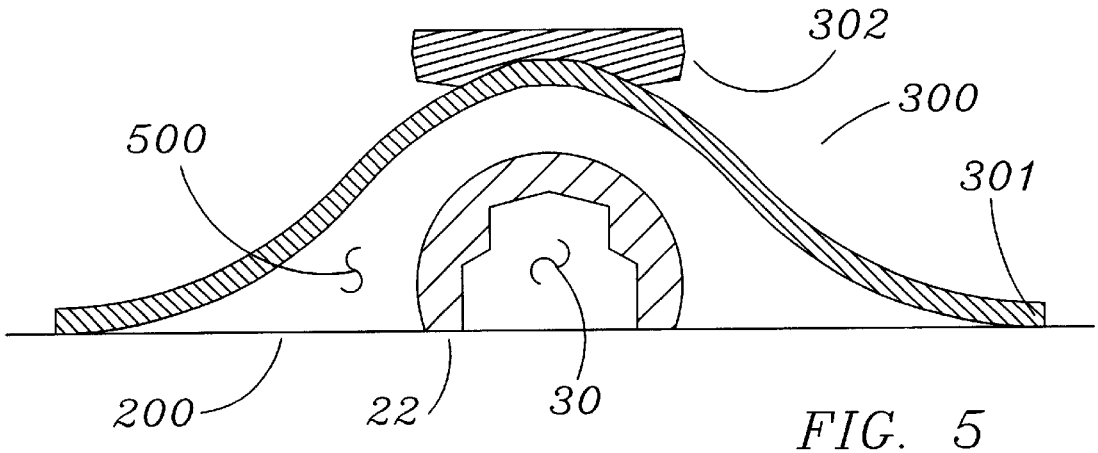
FIG. 5 is a side cross-sectional view of the version of the invention of FIG. 2 being applied to the user's moist skin with a suction cup.

As seen in the cross-sectional views of FIGS. 4 and 5, the body 20 may be manufactured by drilling. In this manner, the lower sidewall 24 and shoulder 25 are formed initially. A smaller bit may be used to form the upper sidewall 26 and inner top surface 27.

In a preferred application, the body piercing jewelry substitute 10 is made of metal. However, alternative materials could be substituted, as desired.

To adhere the body piercing jewelry substitute to the damp body surface 200 or the wet upper surface 101 of the tongue 100, the air pressure must be reduced in the area 500 adjacent to the body piercing jewelry substitute. Reduction of the air pressure adjacent to the body causes some air to leave the cavity defined within the body by passing out of the opening 23. Two principle methods of reducing the air pressure are used. A first method is adapted to application of the jewelry 10 to the tongue. In this circumstance, the user orally sucks on the jewelry. A second method is adapted to application of the jewelry to damp skin. In this circumstance, the user employs a suction cup to reduce the air pressure adjacent to the jewelry.

As seen in FIG. 4, where the body 20 is carried by the user's tongue, the air pressure is reduced by the user orally sucking on the body 20, while maintaining the tongue in contact with the rim 22 which defines the opening 23. It is typically possible to sufficiently reduce the air pressure in the area 500 adjacent to the body 20 by withdrawing the tongue while keeping the lips closed. Care should be taken during this process to keep the desired location of the tongue adjacent to the rim 22 at the base of the body 20.

As seen in FIG. 5, the body may be carried by slightly dampened skin such as the outside surface of the cheek. In this circumstance, the rim 22 is in contact with the damp skin 200.

By placing the suction cup over 300 and enclosing the jewelry 10, the user may isolate the jewelry 10 from the general atmosphere. By pulling up on the handle 302, the internal volume defined within suction cup may be increased. However, because the rim 301 continues to adhere to the surface 200, air is unable to enter the region 500, and the air pressure within the region is reduced. Reducing the air pressure tends to cause air to exit from the cavity 30, by passing through the opening 23.

Having established a partial vacuum for sufficient time to allow some air to exit from the cavity 30, the user then ceases to orally suck on the jewelry or releases the suction cup, depending on application.

This action restores the air pressure to normal levels in the area adjacent to the body. Due to the lower air pressure within the cavity of the body, the surface of the tongue 102 or skin is drawn slightly into the opening 23 defined by the rim 22 of the body, thereby maintaining a seal between the tongue or skin and the rim 22. Air attempting to reenter the low pressure region in cavity 30 tends to strengthen the seal between the rim 22 and the surface 101 or 200. In this manner, air pressure holds the jewelry 10 on the surface of the tongue or damp skin.

Figure 6:
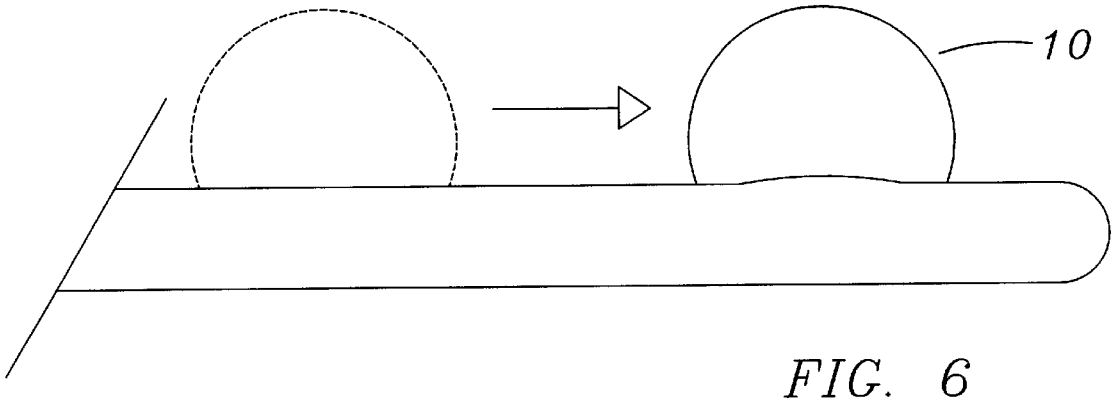
FIG. 6 is a side orthographic view of the version of the invention of FIG. 2 being slid along wet skin surface from the location of application to the preferred location for wearing.

As seen in FIG. 6, the body piercing jewelry substitute may then be moved by sliding the lower rim 22 along the damp surface of the tongue or skin. For example, the body piercing jewelry substitute may be slid from the cheek to the lip or nose, if desired. It is generally the case that the pathway along which the jewelry is slid must be sufficiently damp to maintain the air-tight seal at the rim 22.

The body piercing jewelry substitute may then be removed by gently breaking the seal between the rim 22 and the supporting surface 101 of the tongue or skin.

The previously described versions of the present invention have many advantages, including a primary advantage of providing a novel body piercing jewelry substitute and method of application which does not require the skin of the user to be pierced.

Another advantage of the present invention is to provide a novel body piercing jewelry substitute and method of application which may more easily put on and taken off by the user than conventional body piercing jewelry.

A still further advantage of the present invention is to provide a novel body piercing jewelry substitute and method of application which does not result in body deformation, disease or susceptibility to infection.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while the exterior sidewall 21 of the body 20 of the preferred version of the invention is illustrated as rounded, other shapes, such as multi-faceted construction, could be substituted. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of applying a body piercing jewelry substitute to a user's body, comprising:

(A) selecting a location on the user's body for the application of the body piercing jewelry substitute;

(B) dampening the selected location, thereby forming a damp body surface;

(C) placing the body piercing jewelry substitute, having an exterior sidewall within which is defined an interior cavity and having a lower rim defining an opening which allows air to move into and out of the cavity, on the selected location on the damp body surface with the lower rim in contact with the damp body surface;

(D) reducing the air pressure in the area adjacent to the body piercing jewelry substitute, thereby causing some air to leave the cavity defined within the exterior sidewall and producing a seal between the lower rim and the damp body surface; and (E) restoring the air pressure to normal levels in the area adjacent to the body.

2. The method of applying a body piercing jewelry substitute to a user's body of claim 1, additionally comprising:

(A) moving the body piercing jewelry substitute by sliding the lower rim along the damp body surface.

3. The method of applying a body piercing jewelry substitute to a user's body of claim 1, additionally comprising:

(A) removing the body piercing jewelry substitute by breaking a seal between the rim and the damp body surface.

4. The method of applying a body piercing jewelry substitute to a user's body of claim 1, wherein the air pressure is reduced by the user orally sucking.

5. The method of applying a body piercing jewelry substitute to a user's body of claim 1, wherein the air pressure is reduced by application of a suction cup.

* * * * *